US006481237B2

(12) United States Patent
Kim

(10) Patent No.: US 6,481,237 B2
(45) Date of Patent: Nov. 19, 2002

(54) CEILING-EMBEDDED CASSETTE TYPE AIR CONDITIONER HAVING AN IMPROVED FLUID CHANNEL

(75) Inventor: Sung Chun Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/885,107

(22) Filed: Jun. 21, 2001

(65) Prior Publication Data

US 2002/0108391 A1 Aug. 15, 2002

(30) Foreign Application Priority Data

Feb. 12, 2001 (KR) ..... 01/6795

(51) Int. Cl.[7] ..... F25D 17/04

(52) U.S. Cl. ..... 62/407; 62/259; 62/279; 62/426; 62/324

(58) Field of Search ..... 62/407, 259, 279, 62/426, 419, 324; 454/233

(56) References Cited

U.S. PATENT DOCUMENTS 3,664,253 A * 5/1972 Asker et al. ..... 98/36
3,766,750 A * 10/1973 Aoh et al. ..... 62/259
4,633,768 A * 1/1987 Benson ..... 98/34.6
4,641,502 A * 2/1987 Aldrich et al. ..... 62/244
4,838,150 A * 6/1989 Suzuki et al. ..... 98/31.5
5,353,862 A * 10/1994 Akiyama ..... 165/21
5,577,958 A * 11/1996 Kumekawa et al. ..... 454/233
6,339,934 B1 * 1/2002 Yoon et al. ..... 62/244

* cited by examiner

*Primary Examiner*—William C. Doerrler
*Assistant Examiner*—Mark Shulman
(74) *Attorney, Agent, or Firm*—Birch, Stewart, Kolasch & Birch, LLP

(57) ABSTRACT

A ceiling-embeded cassette type air conditioner has a driving fan, a heat exchanger, a cabinet, and a deflector. An air is controlled to have desired temperature and humidity while passing the driving fan and the heat exchanger. The cabinet and the heat exchanger define a fluid channel guided to exhaust ports between the cabinet and the heat exchanger. The deflector extends straight and inclined to the heat exchanger, so as to enable the air to smoothly flow toward the exhaust ports without a secondary air-flow. By the fluid channel, the quantity of blown-air is increased with the same motor while the noise is reduced with the same quantity of blown-air. Consequently, the performance and the efficiency of the air conditioner are improved.

20 Claims, 6 Drawing Sheets

CEILING-EMBEDDED CASSETTE TYPE AIR CONDITIONER HAVING AN IMPROVED FLUID CHANNEL

BACKGROUND OF THE INVENTION

1. Field of the Invention

The present invention relates to an air conditioner for purifying an indoor air and properly controlling the temperature and humidity of the indoor air to be maintained at a desired level, thereby providing more pleasant life environment. More particularly, the present invention relates to a ceiling-embeded cassette type air conditioner, which is installed to an indoor ceiling of a building without a separate area for installing the air conditioner, to thereby enable even a small indoor space to be efficiently utilized, and which enables the air to smoothly flow in the air conditioner and to be more smoothly diffused in the indoor space when the air is exhausted from the air conditioner.

2. Description of the Related Art

Hereinafter, firstly given will be a description of an entire construction of a conventional ceiling-embeded cassette type air conditioner, which will be followed by a description of a conventional turbo fan structure employed in the conventional ceiling-embeded cassette type air conditioner.

FIG. 1 is a bottom view of a conventional ceiling-embeded cassette type air conditioner.

Referring to FIG. 1, the conventional ceiling-embeded cassette type air conditioner has a suction port 11, through which indoor air is introduced, and exhaust ports 12 formed around the suction port 11. In the conventional air conditioner, the indoor air or the external air introduced through the suction port 11 is cooled to have desired temperature and humidity by means of a heat exchanger employed in the air conditioner, and then the cooled air is exhausted through the exhaust ports 12, so as to maintain the indoor air at a more pleasant state.

Hereinafter, the construction and the operation of the conventional ceiling-embeded cassette type air conditioner will be described in detail, with reference to the internal construction of the conventional ceiling-embeded cassette type air conditioner. FIGS. 2 and 3 are transverse and longitudinal sections of the conventional ceiling-embeded cassette type air conditioner.

Referring to FIGS. 2 and 3, in the ceiling-embeded cassette type air conditioner, the external air is introduced through the suction port 11, which is disposed at a lower portion of the air conditioner, and then the air passes through a bell mouth 16 having a specific shape for decreasing a reduction of pressure, thereby preventing the decrease of efficiency due to the reduction of pressure. Further, the air conditioner includes a driving motor 13 for generating a rotation force and a turbo fan 17 coupled to a rotation shaft of the driving motor 13, so that the indoor air is introduced into the air conditioner by the rotation of the turbo fan 17.

Moreover, the indoor air, which has passed through the suction port 11, the bell mouth 16 and the turbo fan 17 in order, absorbs or discharges heat at a heat exchanger 14, according to the operation state of the ceiling-embeded cassette type air conditioner.

Then, the indoor air, which has passed through the heat exchanger 14 to have desired temperature and humidity, is discharged through the exhaust ports 12 into an indoor space to be air-conditioned. In this case, the indoor air is guided to the exhaust ports 12 by a channel defined according to size and shape of a cabinet 15.

Hereinafter, an air-flow in the ceiling-embeded cassette type air conditioner as mentioned above will be described in detail, with reference to FIG. 4, which is a sectional view for showing the air-flow.

Referring to FIG. 4, the indoor air is introduced through the suction port 11 by a suction force generated by the driving motor 13 and the turbo fan 17, and the air sucked by the turbo fan 17 is adjusted to have a temperature and a humidity preset by a user while passing through the heat exchanger 14. Thereafter, the air is guided through a fluid channel defined according to the construction of the cabinet 15 and then exhausted through the exhaust port 12. This flow of the air has been well indicated by the arrows in FIG. 4.

Meanwhile, in the conventional ceiling-embeded air conditioner as described above, the air having passed the heat exchanger 14 comes into collision with the cabinet 15, which is the first barrier, so that the flow of the air is disturbed by the cabinet 15. In a more detailed description, the cabinet 15 disturbs a normal flow of the air, so as to generate a secondary flow of the air and increase noise due to the secondary air-flow. Further, the secondary air-flow as described above functions to deteriorate the efficiency of the air conditioner.

In FIG. 4, numeral 21 designates the area 21, in which the secondary air-flow as described above happens.

SUMMARY OF THE INVENTION

Accordingly, the present invention has been made in an effort to solve the problems occurring in the related art, and it is an object of the present invention to provide a ceiling-embeded cassette type air conditioner having an improved fluid channel, in which the air can smoothly flow without the secondary air-flow, so that a generation of noise can be reduced and the efficiency of the air conditioner is improved.

In accordance with one aspect of the present invention, there is provided a ceiling-embeded cassette type air conditioner comprising: a driving fan and a heat exchanger for controlling an air to have desired temperature and humidity while passing the driving fan and the heat exchanger; a cabinet, the cabinet and the heat exchanger defining a fluid channel guided to exhaust ports between the cabinet and the heat exchanger; and a deflector extending straight and inclined to the heat exchanger, so as to enable the air to smoothly flow toward the exhaust ports without a secondary air-flow.

By the fluid channel of the present invention, the quantity of blown-air is increased with the same motor while the noise is reduced with the same quantity of blown-air. Consequently, this advantage eventually improves the performance and the efficiency of the air conditioner.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

The above and other objects, characteristics, and advantages of the present invention will become apparent from the following description with reference to the accompanying drawings.

Figure 5:
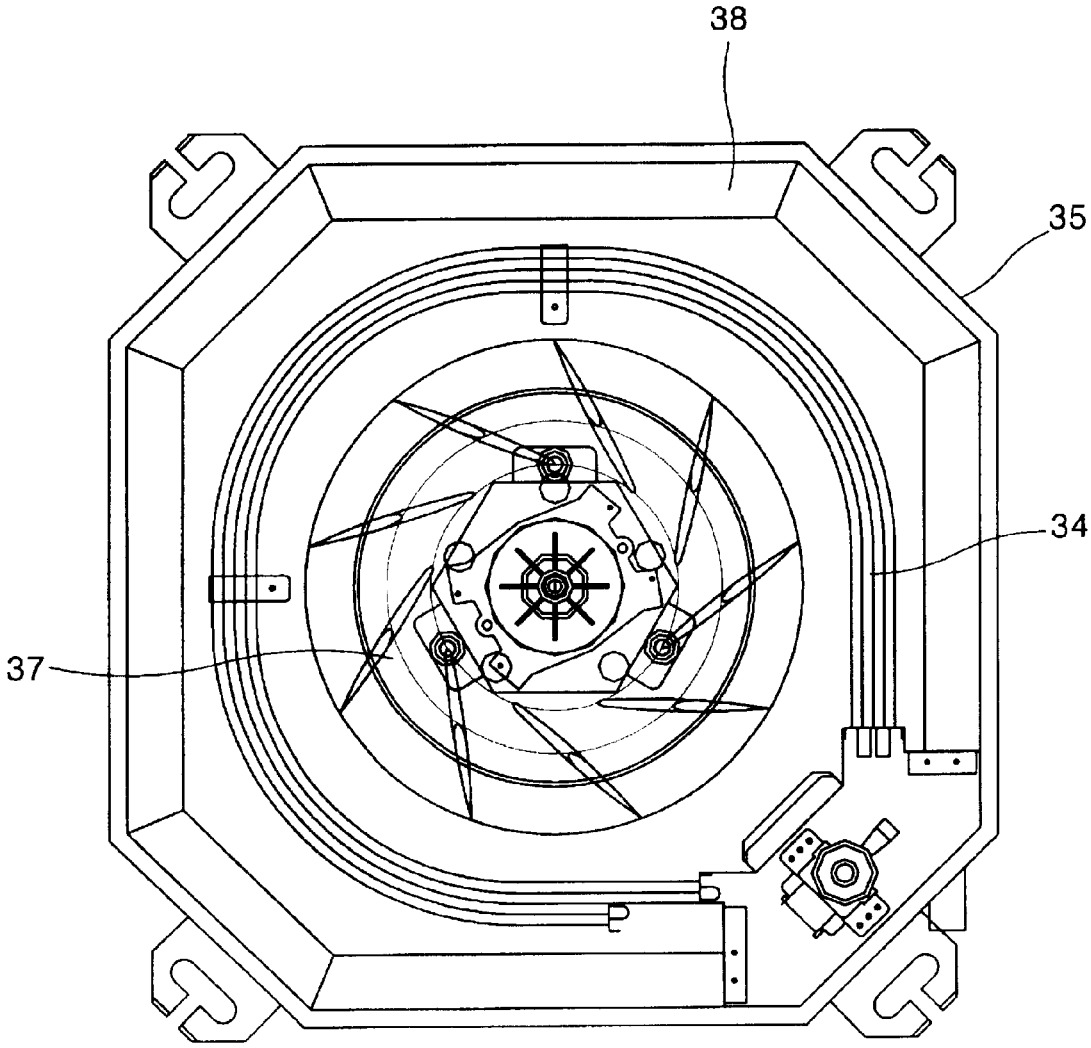
FIG. 5 is a transverse section of the ceiling-embeded cassette type air conditioner according to the present invention, for describing the construction of a fluid channel thereof.
Figure 6:
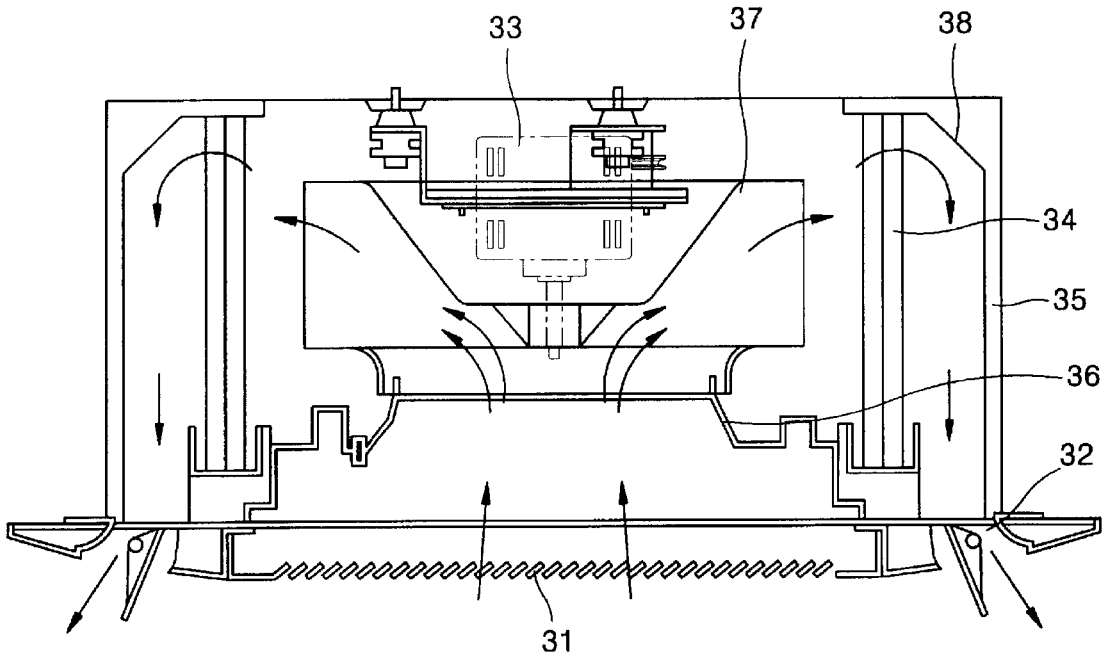
FIG. 6 is a longitudinal section of the ceiling-embeded cassette type air conditioner according to the present invention, for describing the construction of a fluid channel thereof.

FIGS. 5 and 6 are transverse and longitudinal sections of the ceiling-embeded cassette type air conditioner according to the present invention, for describing the construction of a fluid channel thereof.

Referring to FIGS. 5 and 6, the ceiling-embeded cassette type air conditioner includes a driving motor 33 for providing a suction force used in sucking an indoor air, a turbo fan 37 coupled to a rotation shaft of the driving motor 33, a heat exchanger 34 for controlling temperature and humidity of the indoor air, and exhaust ports 32 through which the air having passed the heat exchanger 34 is exhausted again into an indoor space.

Also, the ceiling-embeded cassette type air conditioner further includes a suction port 31, through which the indoor air is sucked by means of the suction force generated by the turbo fan 37, and a bell mouth 36 extending from the suction port 31 so as to reduce compression-loss or pressure-loss of the indoor air sucked through the suction port 31.

In the meantime, the ceiling-embeded cassette type air conditioner of the present invention further includes a deflector 38, an element for preventing the secondary air-flow which may be generated when the air exhausted through the turbo fan 37 and the heat exchanger 34 comes into collision with a cabinet 35, and thereby preventing the efficiency of the air conditioner from being deteriorated and noise from being generated due to the secondary flow. The air having desired temperature and humidity after passing the heat exchanger 34 can be more smoothly guided to the exhaust ports 32 by the above-described deflector 38, so that the pressure-loss of the air is reduced.

Figure 1:
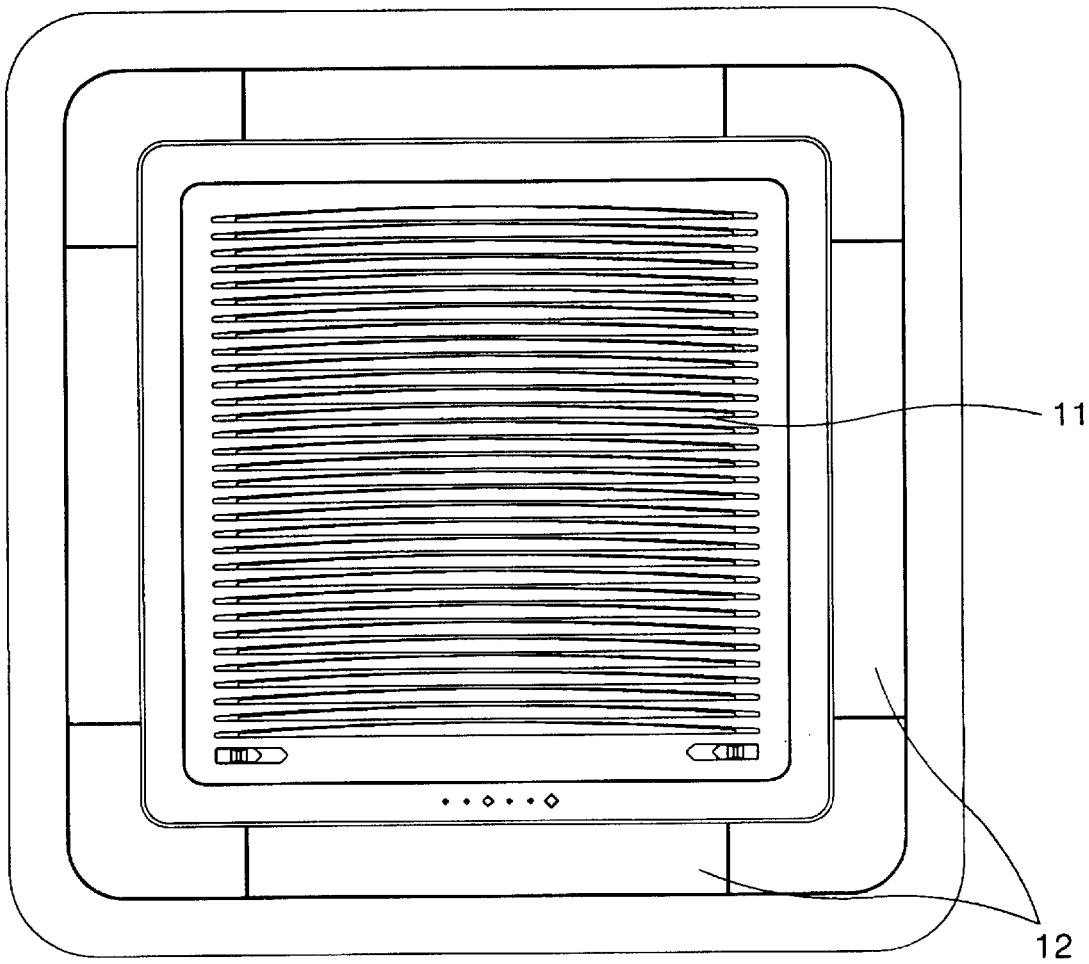
FIG. 1 BACKGROUND ART
FIG. 1 is a bottom view of a conventional ceiling-embeded cassette type air conditioner.
Figure 2:
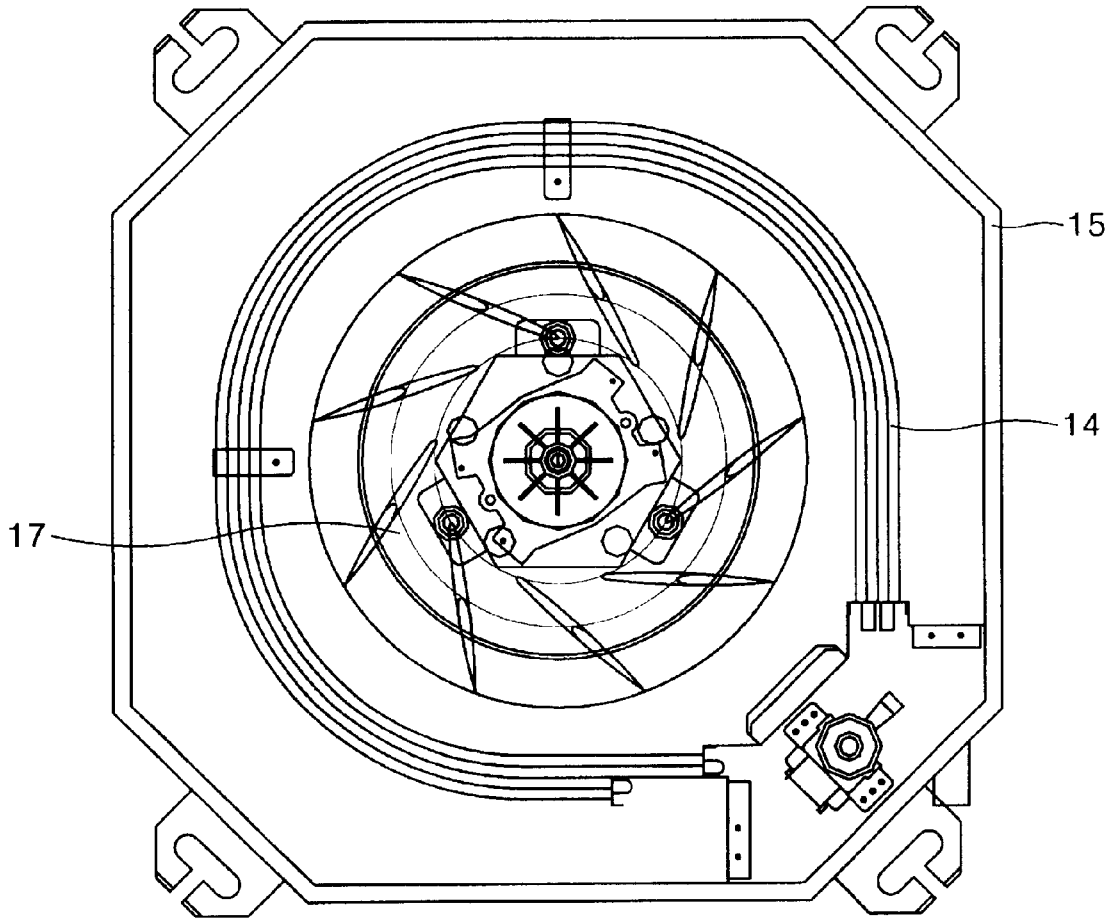
FIG. 2 BACKGROUND ART
FIG. 2 is a transverse section of the conventional ceiling-embeded cassette type air conditioner.
Figure 3:
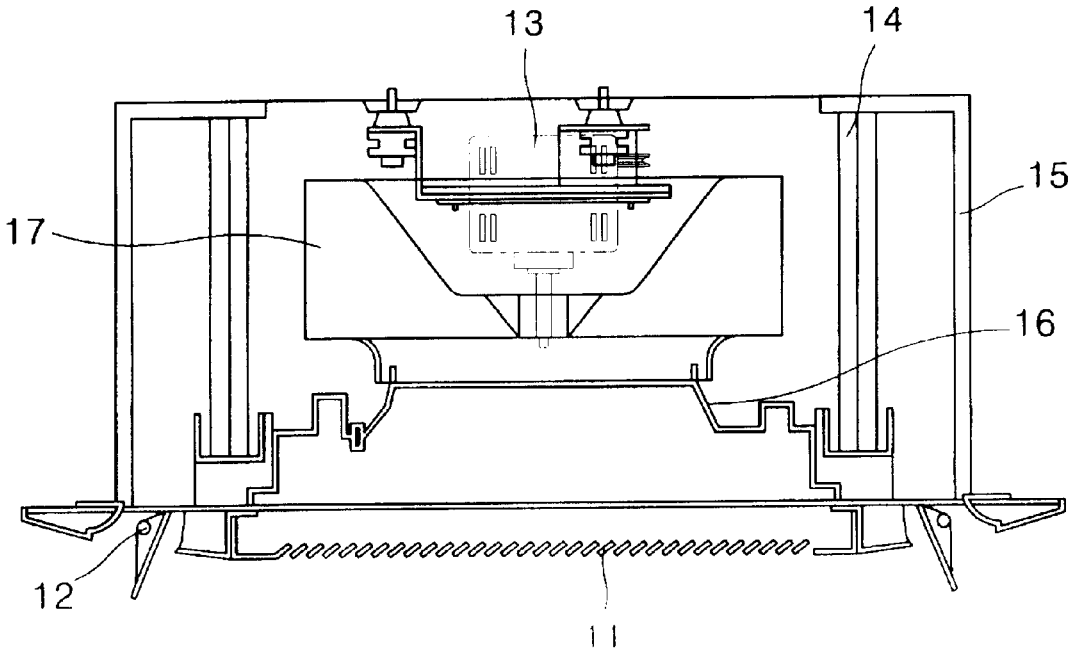
FIG. 3 BACKGROUND ART
FIG. 3 is a longitudinal section of the conventional ceiling-embeded cassette type air conditioner.
Figure 4:
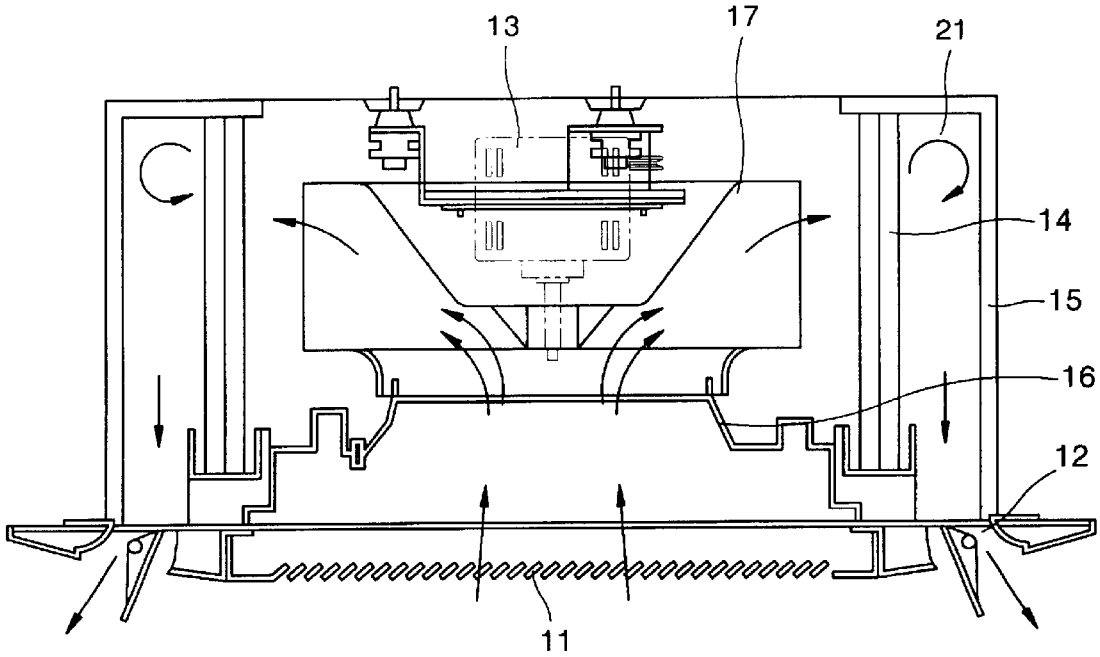
FIG. 4 BACKGROUND ART
FIG. 4 is a sectional view of the conventional ceiling-embeded cassette type air conditioner, for showing an air-flow therein.

In FIG. 6, arrows indicate the flow of the air in the air conditioner. As shown, the secondary air-flow area, which has been observed in the conventional air conditioner as designated by numeral 21 in FIG. 4, is not observed any longer, but the air is smoothly exhausted, in the ceiling-embeded cassette type air conditioner of the present invention as shown in FIG. 6.

Hereinafter, described will be particular dimensions of the deflector 38, which have been obtained through various experiments and proposed to achieve the best advantages within the concept of the present invention.

Figure 7:
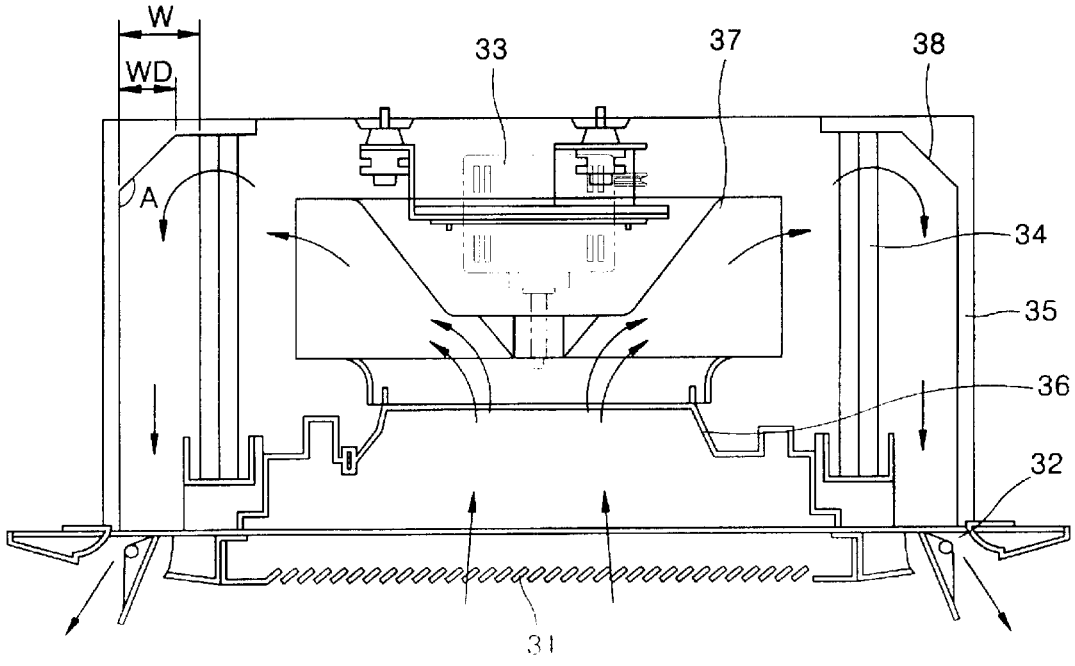
FIG. 7 is a longitudinal section of the ceiling-embeded cassette type air conditioner according to the present invention, for describing the detailed dimensions of the deflector.

FIG. 7 is a sectional view for describing the detailed dimensions of the deflector.

Referring to FIG. 7, as described above, the ceiling-embeded cassette type air conditioner includes the suction port 31, through which the air is sucked, the driving motor 33 and the turbo fan 37 for generating the suction force for sucking the air, the heat exchanger 34 for controlling the temperature and the humidity of the air by exchanging heat with the air, and the cabinet 35 and the exhaust ports 32 for providing a fluid channel, through which the air is exhausted after the heat-exchange. Further, the air conditioner also includes the deflector 38, which ensures the air having the desired temperature and humidity after passing the heat exchanger 34 to be exhausted through the fluid channel without being hindered.

The deflector 38 prevents the secondary flow from happening in the air being exhausted after passing the heat exchanger 34, so as to reduce the resistance to the flow of the air and the noise. In the following description about the detailed dimensions of the deflector 38, WD, W,. and A respectively mean the width of the deflector, the width of the fluid channel, and the inclination angle.

First, the width of the deflector WD has a value in a range of 60 to 100% of the width of the fluid channel W, and the inclination angle A of the deflector has a value between 120 and 150 degrees. Consequently, the possible secondary air-flow is effectively prevented, so that the air can smoothly flow and the noise can be reduced.

Meanwhile, it is preferred in an aspect of manufacturing the deflector 38 that the deflector 38 is formed to be flat within the limit by the above dimensions of the deflector.

As a result of experiments by the ceiling-embeded cassette type air conditioner employing the deflector having the dimensions as proposed above together with a conventional driving motor, it has been estimated that the noise is reduced by about 0.6 dB at the same quantity of the blown-air, which is 13 CMM.

Further, even in the case where the deflector has a shape curved outward, the same effect can be obtained. In this case, the outwardly curved deflector preferably has the following dimensions.

That is, the width WD of the deflector has a value in a range of 60 to 100% of the width W of the fluid width W, and the curved surface of the deflector 38 has a radius R of curvature, which is larger than two times of the width WD of the deflector, so that the secondary air-flow can be effectively prevented and the generation of noise is reduced. Consequently, the disturbance to the flow of the air is reduced, so that the performance of the air conditioner is improved.

The detailed dimensions of the ceiling-embeded cassette type air conditioner as described above have been obtained through many experiments under various conditions, and cannot be obtained by a simple addition of the prior arts.

While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. A ceiling-embedded cassette type air conditioner comprising:

a drive fan and a heat exchanger for controlling an air to have desired temperature and humidity while passing the drive fan and the heat exchanger;

a cabinet, the cabinet and the heat exchanger defining a fluid channel to guide air to exhaust ports between the cabinet and the heat exchanger; and a deflector located in the fluid channel remote from the exhaust ports, the deflector extending straight and inclined to the heat exchanger, so as to enable the air to smoothly flow toward the exhaust ports without a secondary air-flow.

2. A ceiling-embedded cassette type air conditioner as claimed in claim 1, wherein the deflector has a width having a value in a range of 60 to 100% of a width of the fluid channel between the heat exchanger and the cabinet.

3. A ceiling-embedded cassette type air conditioner as claimed in claim 1, wherein an inclination angle of the deflector cabinet has a value between 120 and 150 degrees.

4. A ceiling-embedded cassette type air conditioner comprising:

a drive fan and a heat exchanger for controlling an air to have desired temperature and humidity while passing the drive fan and the heat exchanger;

a cabinet, the cabinet and the heat exchanger defining a fluid channel to guide air to exhaust ports between the cabinet and the heat exchanger; and a deflector located in the fluid channel remote from the exhaust ports, the deflector having a shape curved outward, so as to enable the air to smoothly flow toward the exhaust ports without a secondary air-flow.

5. A ceiling-embedded cassette type air conditioner as claimed in claim 4, wherein the deflector has an outwardly-curved surface whose radius of curvature is larger than two times a width of the deflector.

6. A ceiling-embedded cassette type air conditioner as claimed in claim 4, wherein the deflector has a width having a value in a range of 60 to 100% of a width of the fluid channel between the heat exchanger and the cabinet.

7. A ceiling-embedded cassette type air conditioner comprising:

a cabinet having an air inlet and an air exhaust port;

a heat exchanger housed in said cabinet;

a fan housed in said cabinet, said fan causing air to enter said air inlet, flow past said heat exchanger, and exit said air exhaust port;

an air flow channel defined in said cabinet between an inside wall of said cabinet and said heat exchanger, said air flow channel beginning adjacent to said heat exchanger and ending adjacent to said air exhaust port; and a deflector located proximate said beginning of said air flow channel, said deflector presenting a surface to redirect an air flow in said air flow channel, said surface extending at an incline to said heat exchanger, so as to enable air to smoothly flow toward said exhaust port without a secondary air-flow.

8. A ceiling-embedded cassette type air conditioner as claimed in claim 7, wherein said air flow channel extends in a substantially vertical direction, and wherein said deflector is located at a top of said air flow channel.

9. A ceiling-embedded cassette type air conditioner as claimed in claim 8, wherein said exhaust port is located at a bottom of said air flow channel.

10. A ceiling-embedded cassette type air conditioner as claimed in claim 9, wherein said surface of said deflector is flat.

11. A ceiling-embedded cassette type air conditioner as claimed in claim 9, wherein said surface of said deflector is curved outward.

12. A ceiling-embedded cassette type air conditioner as claimed in claim 7, wherein said heat exchanger substantially encircles said fan, and wherein said air flow channel substantially encircles said heat exchanger.

13. A ceiling-embedded cassette type air conditioner as claimed in claim 7, wherein said heat exchanger substantially encircles said fan, and wherein said air flow channel with said deflector substantially encircle said heat exchanger.

14. A ceiling-embedded cassette type air conditioner as claimed in claim 7, wherein said air inlet is positioned in a central lower region of said ceiling-embedded cassette type air conditioner, and wherein said air exhaust port substantially encircles said air inlet.

15. A ceiling-embedded cassette type air conditioner as claimed in claim 7, wherein said surface of said deflector is flat.

16. A ceiling-embedded cassette type air conditioner as claimed in claim 15, wherein said air flow channel has a first width, taken in a direction from said heat exchanger to said inside wall of said cabinet, wherein said deflector has a second width, also taken in the direction from said heat exchanger to said inside wall of said cabinet, and wherein the second width is 60 to 100% of the first width.

17. A ceiling-embedded cassette type air conditioner as claimed in claim 15, wherein the incline of said surface relative to said inside wall of said cabinet is between 120 and 150 degrees.

18. A ceiling-embedded cassette type air conditioner as claimed in claim 7, wherein said surface of said deflector is curved outward.

19. A ceiling-embedded cassette type air conditioner as claimed in claim 18, wherein said deflector has a width, taken in a direction from said heat exchanger to said inside wall of said cabinet, wherein the curve of said surface has a radius, and wherein the radius is at least two times the width.

20. A ceiling-embedded cassette type air conditioner as claimed in claim 18, wherein said air flow channel has a first width, taken in a direction from said heat exchanger to said inside wall of said cabinet, wherein said deflector has a second width, also taken in the direction from said heat exchanger to said inside wall of said cabinet, and wherein the second width is 60 to 100% of the first width.

* * * * *